US010774828B1

(12) United States Patent
Smith

(10) Patent No.: US 10,774,828 B1
(45) Date of Patent: Sep. 15, 2020

(54) COMPOSITE VALVE SEAT SYSTEM AND METHOD

(71) Applicant: Vulcan Industrial Holdings, LLC, Houston, TX (US)

(72) Inventor: Jason David Smith, Houston, TX (US)

(73) Assignee: VULCAN INDUSTRIAL HOLDINGS LLC, Houston, TX (US)

( * ) Notice: Subject to any disclaimer, the term of this patent is extended or adjusted under 35 U.S.C. 154(b) by 0 days.

(21) Appl. No.: 16/746,519

(22) Filed: Jan. 17, 2020

(51) Int. Cl.
*F04B 53/10* (2006.01)

(52) U.S. Cl.
CPC ..... *F04B 53/1022* (2013.01); *F04B 53/1087* (2013.01); *F04B 53/108* (2013.01); *Y10T 137/7559* (2015.04); *Y10T 137/7904* (2015.04); *Y10T 137/7929* (2015.04); *Y10T 137/86019* (2015.04)

(58) Field of Classification Search
CPC ..... Y10T 137/7904; Y10T 137/7929; Y10T 137/7559; Y10T 137/86019; F04B 53/1022; F04B 53/1087; F04B 53/108
See application file for complete search history.

(56) References Cited

U.S. PATENT DOCUMENTS 1,671,139 A 5/1928 Wilson
1,873,318 A * 8/1932 Eason, Jr. ..... F04B 53/1027 137/533.21
1,914,737 A * 6/1933 Elms ..... F04B 53/1027 251/175
1,948,628 A * 2/1934 Penick ..... F04B 53/1027 251/332
2,011,547 A * 8/1935 Campbell ..... F04B 53/1027 137/516.29

(Continued)

FOREIGN PATENT DOCUMENTS

CN 201149099 11/2008
CN 102410194 4/2012

(Continued)

OTHER PUBLICATIONS

Flowserve, "Dynamic Balance Plug Valve and Double DB Plug Valve: Installation, Operation and Maintenance," 2011, https://www.flowserve.com/sites/default/files/2016-07/NVENIM2005-00_0.pdf, 36 pages.

(Continued)

*Primary Examiner* — Marina A Tietjen
*Assistant Examiner* — Frederick D Soski
(74) *Attorney, Agent, or Firm* — Hogan Lovells US LLP

(57) ABSTRACT

A valve assembly for a fracturing pump includes a valve seat having a bore extending therethrough, the valve seat including a strike face at a top region opposite a bottom region, at least a portion of the strike face formed by an insert positioned within a groove formed in the valve body. The valve assembly also includes a bore liner arranged within the bore, at least a portion of an axial length of the bore liner covering at least a portion of the ceramic to form a barrier between the insert and the bore. The valve assembly further includes a valve member positioned to reciprocate within the bore, the valve member moving between an open position and a closed position, wherein at least a portion of the valve member engages at least a portion of the strike face in the closed position.

18 Claims, 7 Drawing Sheets

(56) References Cited

U.S. PATENT DOCUMENTS 2,103,503 A * 12/1937 White ..... F04B 53/1027 137/329.04
2,143,399 A * 1/1939 Abercrombie ..... F04B 53/1022 137/540
2,304,991 A * 12/1942 Foster ..... F04B 53/1027 137/454.4
2,506,128 A 5/1950 Ashton
2,547,831 A 4/1951 Mueller
2,745,631 A * 5/1956 Shellman ..... F04B 53/1027 251/175
2,898,082 A * 8/1959 Von Almen ..... F04B 53/1027 251/333
2,969,951 A * 1/1961 Walton ..... F04B 53/1027 251/332
2,982,515 A * 5/1961 Rule ..... F16K 1/465 251/332
2,983,281 A * 5/1961 Bynum ..... F04B 53/1087 137/543.23
3,063,467 A * 11/1962 Roberts, Jr. ..... F16K 1/465 137/516.29
3,224,817 A 12/1965 Miller
3,276,390 A 10/1966 Bloudoff
3,474,808 A * 10/1969 Elliott ..... F16K 15/063 137/543
3,489,170 A * 1/1970 Leman ..... F16K 1/385 137/516.29
3,809,508 A 5/1974 Uchiyama
4,044,834 A * 8/1977 Perkins ..... E21B 21/08 166/370
4,076,212 A * 2/1978 Leman ..... F16K 1/46 137/516.29
4,184,814 A * 1/1980 Parker ..... F04B 53/1027 137/454.4
4,518,329 A * 5/1985 Weaver ..... F04B 53/1027 137/516.25
4,662,392 A 5/1987 Vadasz
4,763,876 A 8/1988 Oda
4,770,206 A * 9/1988 Sjoberg ..... F04B 53/1027 137/516.29
4,951,707 A * 8/1990 Johnson ..... F16K 1/46 137/516.29
5,020,490 A * 6/1991 Seko ..... F01L 3/22 123/188.8
5,052,435 A * 10/1991 Crudup ..... F16K 15/063 137/516.29
5,061,159 A 10/1991 Pryor
5,062,450 A * 11/1991 Bailey ..... E21B 33/13 137/516.29
5,088,521 A * 2/1992 Johnson ..... E21B 21/01 137/516.29
5,209,495 A 5/1993 Palmour
5,249,600 A * 10/1993 Blume ..... F04B 53/1087 137/516.29
5,533,245 A * 7/1996 Stanton ..... B25B 27/06 29/213.1
5,540,570 A 7/1996 Schuller
6,382,940 B1 * 5/2002 Blume ..... F04B 53/007 277/435
6,460,620 B1 * 10/2002 LaFleur ..... E21B 21/106 137/881
6,623,259 B1 * 9/2003 Blume ..... F04B 53/007 137/543.23
6,641,112 B2 * 11/2003 Antoff ..... F04B 53/1025 251/363
6,695,007 B2 * 2/2004 Vicars ..... F16K 15/063 137/516.29
6,951,165 B2 * 10/2005 Kuhn ..... F04B 1/0426 92/129
6,955,181 B1 * 10/2005 Blume ..... F16K 15/06 137/15.18
7,168,440 B1 * 1/2007 Blume ..... F04B 53/102 137/15.18
7,186,097 B1 3/2007 Blume
7,222,837 B1 * 5/2007 Blume ..... F16K 1/385 137/516.29
7,296,591 B2 * 11/2007 Moe ..... F04B 53/109 137/454.4
7,341,435 B2 3/2008 Vicars
7,506,574 B2 3/2009 Jensen
7,513,483 B1 * 4/2009 Blume ..... F16K 1/34 137/516.29
7,726,026 B1 6/2010 Blume
7,866,346 B1 1/2011 Walters
7,992,635 B2 * 8/2011 Cherewyk ..... E21B 43/26 166/75.15
8,069,923 B2 12/2011 Blanco
8,083,506 B2 12/2011 Maki
8,402,880 B2 3/2013 Patel
8,528,585 B2 * 9/2013 McGuire ..... F16L 37/088 137/315.01
8,870,554 B2 * 10/2014 Kent ..... F04B 49/10 137/375
9,285,040 B2 3/2016 Forrest
9,377,019 B1 6/2016 Blume
9,435,454 B2 9/2016 Blume
9,528,508 B2 12/2016 Thomeer
9,528,631 B2 * 12/2016 McCarty ..... F16K 41/02
9,822,894 B2 11/2017 Bayyouk
9,927,036 B2 * 3/2018 Dille ..... F16K 1/42
10,221,848 B2 * 3/2019 Bayyouk ..... F04B 53/1087
10,344,757 B1 * 7/2019 Stark ..... B22F 7/08
2003/0205864 A1 11/2003 Dietle
2004/0170507 A1 * 9/2004 Vicars ..... F04B 53/007 417/360
2004/0234404 A1 * 11/2004 Vicars ..... F04B 53/102 417/571
2005/0200081 A1 9/2005 Stanton
2005/0226754 A1 * 10/2005 Orr ..... F04B 53/007 417/571
2006/0045782 A1 3/2006 Kretzinger
2008/0279706 A1 11/2008 Gambier
2009/0261575 A1 10/2009 Bull
2009/0278069 A1 * 11/2009 Blanco ..... F16K 15/063 251/309
2011/0079302 A1 * 4/2011 Hawes ..... F04B 53/102 137/538
2011/0255993 A1 10/2011 Ochoa
2013/0020521 A1 * 1/2013 Byrne ..... F16K 1/385 251/334
2013/0202458 A1 * 8/2013 Byrne ..... F04B 7/02 417/279
2014/0286805 A1 9/2014 Dyer
2015/0144826 A1 * 5/2015 Bayyouk ..... F16K 25/005 251/359
2015/0147194 A1 * 5/2015 Foote ..... F04B 53/16 417/53
2015/0219096 A1 8/2015 Jain
2015/0300332 A1 10/2015 Cobb
2016/0238156 A1 * 8/2016 Hubenschmidt .... F16K 37/0008
2017/0067459 A1 * 3/2017 Bayyouk ..... B23P 6/00
2017/0089473 A1 3/2017 Nowell
2017/0097107 A1 4/2017 Hotz
2017/0298932 A1 * 10/2017 Wagner ..... F04B 53/22
2019/0017503 A1 1/2019 Foster
2019/0145568 A1 * 5/2019 Nick ..... E21B 33/038 138/96 R
2019/0316685 A1 * 10/2019 Wang ..... F16K 15/063

FOREIGN PATENT DOCUMENTS

CN 102748483 10/2012
EP 0414955 3/1991

OTHER PUBLICATIONS

Weir Oil & Gas, "SPM Well Service Pumps & Flow Control Products TWS600S Fluid End Operation Instruction and Service Manual," Feb. 27, 2017, https://www.global.weir/assets/files/oil%

(56) References Cited

OTHER PUBLICATIONS

20and%20gas%20ebrochures/manuals/ tws600s-fluid-end-2p121260.pdf, 41 pages.
White Star Pump Co., "Maintenance Manual: Triplex Pump WS-1300/1600," 2005, http://www.whitestarpump.com/ES/docs/user_t.pdf, 45 pages.

* cited by examiner

COMPOSITE VALVE SEAT SYSTEM AND METHOD

TECHNICAL FIELD

Embodiments of the subject matter disclosed herein generally relate to pump systems, and in particular to valve seats in pump systems.

BACKGROUND

Pumping systems may be used in a variety of applications, especially industrial applications where pumping systems are used to elevate a working fluid pressure. One such application is hydraulic fracturing systems, which high pressure pumps are used to increase a fluid pressure of a working fluid (e.g., fracturing fluid, slurry, etc.) for injection into an underground formation. The working fluid may include particulates, which are injected into fissures of the formation. When the fluid is removed from the formation, the particulates remain and "prop" open the fissures, facilitating flow of oil and gas. In many applications, reciprocating pumps are used where a fluid is introduced into a fluid end inlet passage and out through an outlet passage. A valve assembly reciprocates within the pump and contacts valve seats at the inlet and outlet passages. Due to the particulates and corrosive nature of the working fluid, the valve seats may become eroded or otherwise damaged, which my prevent sealing of the inlet and outlet passages.

SUMMARY

Applicants recognized the problems noted above herein and conceived and developed embodiments of systems and methods, according to the present disclosure, for valve seats in pump systems.

In accordance with one or more embodiments a valve assembly for a fracturing pump includes a valve seat having a bore extending therethrough, the valve seat including a strike face at a top region opposite a bottom region, at least a portion of the strike face formed by an insert positioned within a groove formed in the valve body. The valve assembly also includes a bore liner arranged within the bore, at least a portion of an axial length of the bore liner covering at least a portion of the ceramic to form a barrier between the insert and the bore. The valve assembly further includes a valve member positioned to reciprocate within the bore, the valve member moving between an open position and a closed position, wherein at least a portion of the valve member engages at least a portion of the strike face in the closed position.

In accordance with another embodiment, a valve seat for use in a fracturing pump includes a first body, including at least a portion of a bore and having a first diameter. The valve seat also includes a second body, coupled to the first body. The second body includes a tapered portion having a downward slope from a second diameter to an axis, a groove formed in the tapered portion, the groove extending from at least a second portion of the bore radially outward toward the second diameter, and an insert, positioned within the groove, the insert having a sloped region substantially conforming to the downward slope of the tapered portion. The valve seat also includes a bore liner extending through the bore along at least a portion of both the first body and the second body, the bore liner positioned to overlap at least a portion of the insert.

In accordance with another embodiment, a method for forming a valve seat includes receiving a valve seat, the valve seat including a first body and a second body coupled together, the first body having a larger diameter than the second body, the second body including a tapered portion. The method also includes forming a groove in the tapered portion, the groove extending radially outward from the bore. The method further includes positioning an insert within the groove. The method also includes securing the insert within the groove. The method includes positioning a bore liner along at least a portion of the bore, the bore liner arranged to overlap at least a portion of the insert. The method further includes securing the bore liner to at least one of the bore or the insert.

BRIEF DESCRIPTION OF THE DRAWINGS

The present technology will be better understood on reading the following detailed description of non-limiting embodiments thereof, and on examining the accompanying drawings, in which.

DETAILED DESCRIPTION

Figure 1:
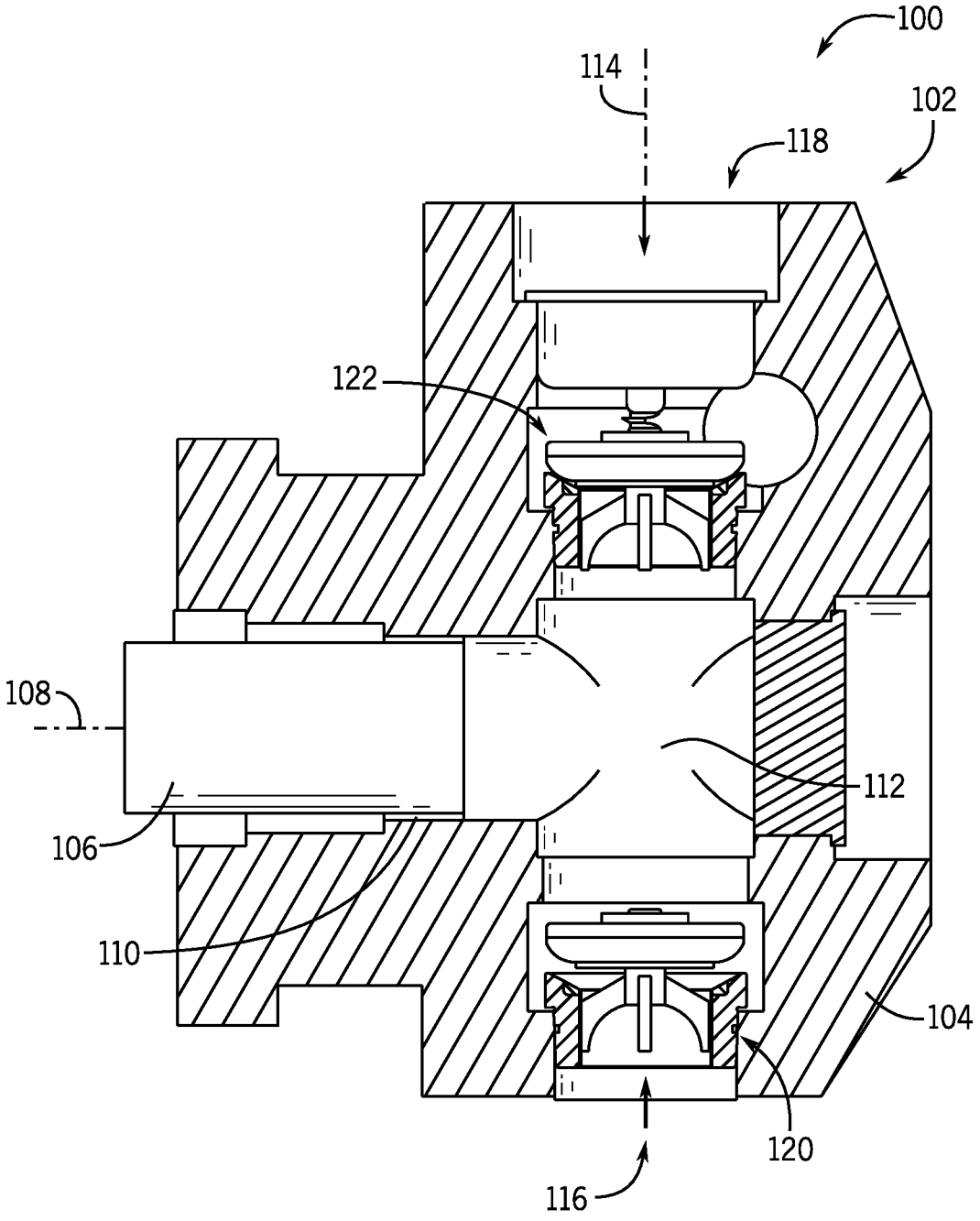
FIG. 1 is a schematic cross-sectional view of an embodiment of a pump assembly, in accordance with embodiments of the present disclosure.

The foregoing aspects, features, and advantages of the present disclosure will be further appreciated when considered with reference to the following description of embodiments and accompanying drawings. In describing the embodiments of the disclosure illustrated in the appended drawings, specific terminology will be used for the sake of clarity. However, the disclosure is not intended to be limited to the specific terms used, and it is to be understood that each specific term includes equivalents that operate in a similar manner to accomplish a similar purpose.

When introducing elements of various embodiments of the present disclosure, the articles "a", "an", "the", and "said" are intended to mean that there are one or more of the elements. The terms "comprising", "including", and "having" are intended to be inclusive and mean that there may be additional elements other than the listed elements. Any examples of operating parameters and/or environmental conditions are not exclusive of other parameters/conditions of the disclosed embodiments. Additionally, it should be understood that references to "one embodiment", "an embodiment", "certain embodiments", or "other embodiments" of the present disclosure are not intended to be interpreted as excluding the existence of additional embodiments that also incorporate the recited features. Furthermore, reference to terms such as "above", "below", "upper", "lower", "side", "front", "back", or other terms regarding orientation or direction are made with reference to the illustrated embodiments and are not intended to be limiting or exclude other orientations or directions.

Embodiments of the present disclosure include a valve seat at least partially formed of a ceramic material on at least a portion of a strike face. Moreover, the valve seat may include an inner flow bore including a wear resistant metallic or polymeric material. In various embodiments, the wear resistant metallic or polymeric material may be fixed to the inner flow bore by bonding, press fitting, sintering, or a combination thereof. The valve seat may include a first and second body, the first body having an outer diameter configured to be inserted into a fluid passageway of a fracturing pump, such as a reciprocating pump. The second body extends radially from the first body, and may be considered integral to the first body in embodiments, and has an outer diameter greater than the outer diameter of the first body. The second body is at least partially formed of a ceramic material. In various embodiments, the second body includes an insert comprising a ceramic material, which may be fixed to the second body by bonding, press fitting, sintering, or a combination thereof.

In various embodiments, systems and methods for forming a valve seat used in positive displacement reciprocating pumps and hydraulic fracturing service designed to pump sand water acid slurry are described. The valve seat is designed to have a wear resistant valve strike face and inner flow bore to extend a service life of the valve seat before replacement or repair. Embodiments may provide significant extension of services lives of the valve seat compared to conventional case-hardened alloy steel valve seats. Prior art valve seats have issues with the strike face wearing down and the inner flow bore eroding or becoming gouged due to the up and down action of the valve wing guided portion. Prior art valve seats including a ceramic insert on the strike face do not have a liner system to prevent contact damage with valve guide legs or erosive damage from fluid flow. In embodiments, the valve strike face is partially formed of ceramic material, such as cemented tungsten carbide or similar, to increase wear resistance of the strike face of the valve seat. Moreover, the inner flow bore of the valve seat is formed of an inner layer of wear resistant metallic or polymer material to prevent flow accelerated erosion of the valve seat flow bore and prevent gouging from up and down motion of the valve which has wing guided feet.

FIG. 1 is a schematic cross-sectional view of an embodiment of a pump assembly 100, which may also be referred to as a reciprocating pump assembly and/or a reciprocating pump. The pump assembly 100 may be utilized during hydraulic fracturing operations, among other operations, where a working fluid (e.g., fracturing fluid, slurry, etc.) is introduced into the pump and energy is added to the working fluid to increase a pressure of the working fluid. Fracturing fluid, by way of example only, may include corrosives and also particulates, such as sand or ceramics, which are utilized during fracturing operations. These corrosives and particulates cause erosion within the pump assembly 100, which may undesirably affect fracturing operations and lead to down times to replace various components. Additionally, the fracturing fluids may include corrosive acids and the like, which may wear down components of the pump assembly 100.

It should be appreciated that various components of the pump assembly 100 have been removed for clarity with the following discussion. For example, a power end has been removed in favor of focusing on the illustrated fluid end 102 of the pump assembly 100. The power end may include a crankshaft that is driven by an engine or motor to facilitate operations. The fluid 102 includes a fluid end block 104 that may house one or more components discussed herein. A plunger rod 106 is driven (e.g., via the crankshaft) to reciprocate within the fluid end block 104 along a plunger axis 108. The plunger rod 106 is positioned within a bore 110 extending through at least a portion of the fluid end block 104. The illustrated bore 110 is arranged along the plunger axis 108 (e.g., first axis) and intersects a pressure chamber 112, which is arranged along a pressure chamber axis 114 (e.g., second axis), which is positioned substantially perpendicular to the plunger axis 108. It should be appreciated that the pump assembly 100 may include multiple plunger rod and pressure chamber arrangements, which may be referred to as a plunger throw. For example, the pump assembly 100 may be a triplex pump, quadplex pump, quintuplex pump, and the like.

The illustrated fluid end block 104 includes an inlet passage 116 and an outlet passage 118, which are generally coaxial and arranged along the pressure chamber axis 114. In other words, the inlet and outlet passages 116, 118 are axially aligned with respect to one another and/or the pressure chamber 112. In various embodiments, fluid enters the pressure chamber 112 via the inlet passage 116, for example on an up stroke of the plunger rod 106, and is driven out of the pressure chamber 112 via the outlet passage 118, for example on a down stroke of the plunger rod 106.

Respective valve assemblies 120, 122 are arranged within the inlet passage 116 and the outlet passage 118. These valve assemblies 120, 122 are spring loaded in the illustrated embodiment, but it should be appreciated that such an arrangement is for illustrative purposes only. In operation, a differential pressure may drive movement of the valve assemblies. For example, as the plunger rod 106 is on the upstroke, pressure at the inlet passage 116 may overcome the spring force of the valve assembly 120, thereby driving fluid into the pressure chamber 112. However, on the down stroke, the valve assembly 120 may be driven to a closed position, while the spring force of the valve assembly 122 is overcome, thereby enabling the fluid to exit via the outlet passage 118.

As will be described in detail below, the valve assemblies 120, 122 may include a valve seat face, which may include a strike face. The strike face may contact a sealing face of a valve member as the valve member transitions between an open position and a closed position. Due to the nature of the working fluid (e.g., corrosive and filled with particulates), wear may develop along the strike face, thereby reducing its sealing effectiveness.

Figure 2:
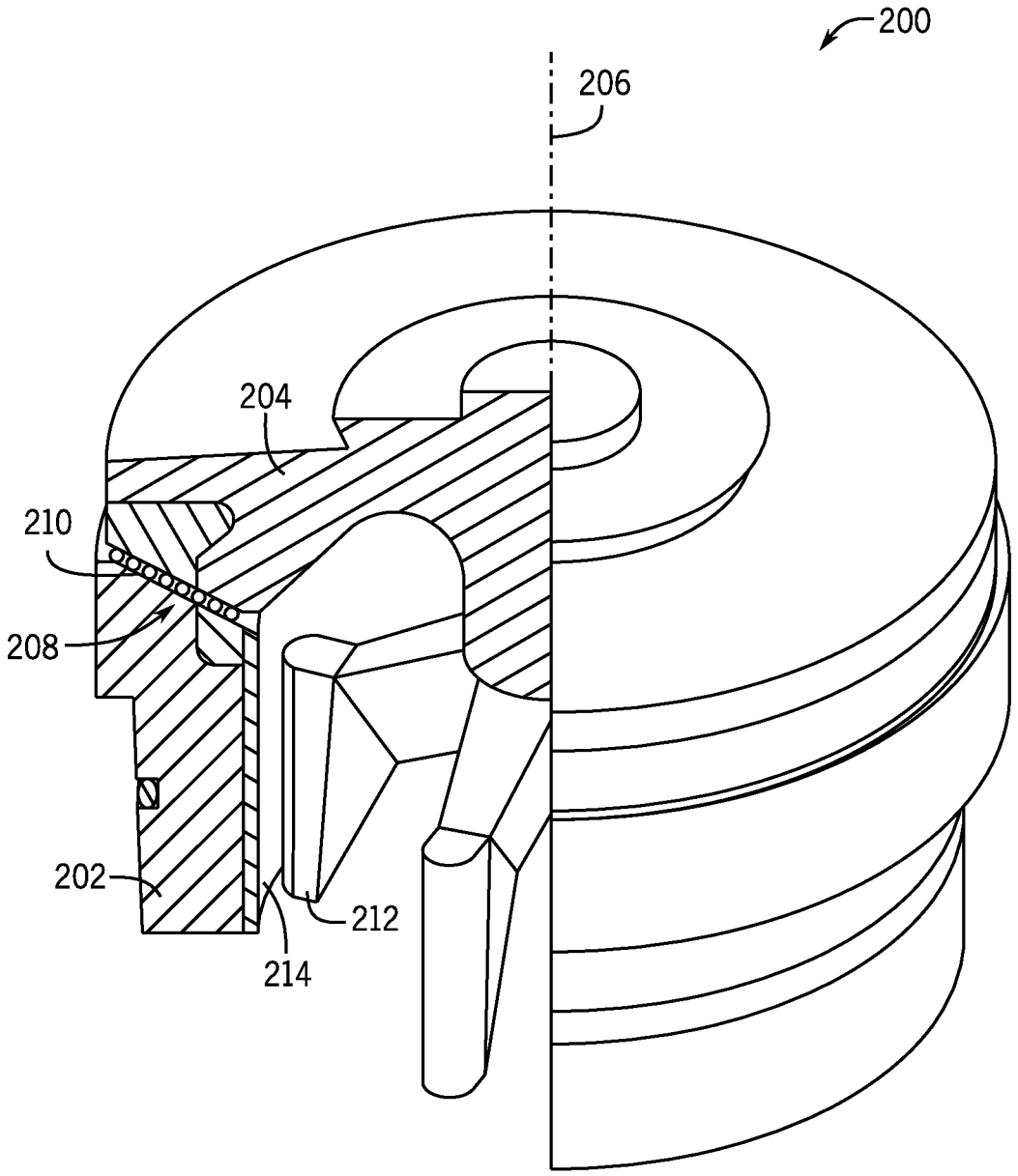
FIG. 2 is a schematic sectional view of an embodiment of a valve assembly, in accordance with embodiments of the present disclosure.

FIG. 2 is a schematic cut away view of an embodiment of a valve assembly 200, such as the valve assemblies 120, 122, which may be utilized with a pump assembly. The illustrated valve assembly 200 includes a valve seat 202 and a valve member 204. In operation, the valve member 204 reciprocates along a valve axis 206, which may correspond to the pressure chamber axis 114, such that the valve member 204 moves into and out of contact with the valve seat 202. In the illustrated embodiment, particulates 208 have accumulated along the valve seat 202, for example at a strike face 210

(e.g., contact face). Repeated contact from the valve member 204 may drive the particulates 208 into the strike face 210, causing scarring or other damage. Additionally, corrosive fluids may contact other portions of the valve seat 202, in addition to the strike face 210. Damage to the valve seat 202 may cause the sealing capability of the valve assembly 200 to degrade, thereby reducing the effectiveness of the pump assembly.

In various embodiments, guide legs 212 of the valve member 204 may also lead to damage to various portions of the valve seat 202. For example, in the illustrated embodiment, the guide legs 212 extend a bore 214 of the valve member 204. Due to the presence of the corrosive fluid and/or the particulates, damage may occur along the bore 214, such as scarring. As a result, the pump assembly may be taken out of service for repairs, which may be expensive and also contribute to non-productive time at the well site. Accordingly, embodiments of the present disclosure are directed toward systems and methods for forming improved valve seats, which may be part of valve assemblies.

Figure 3:
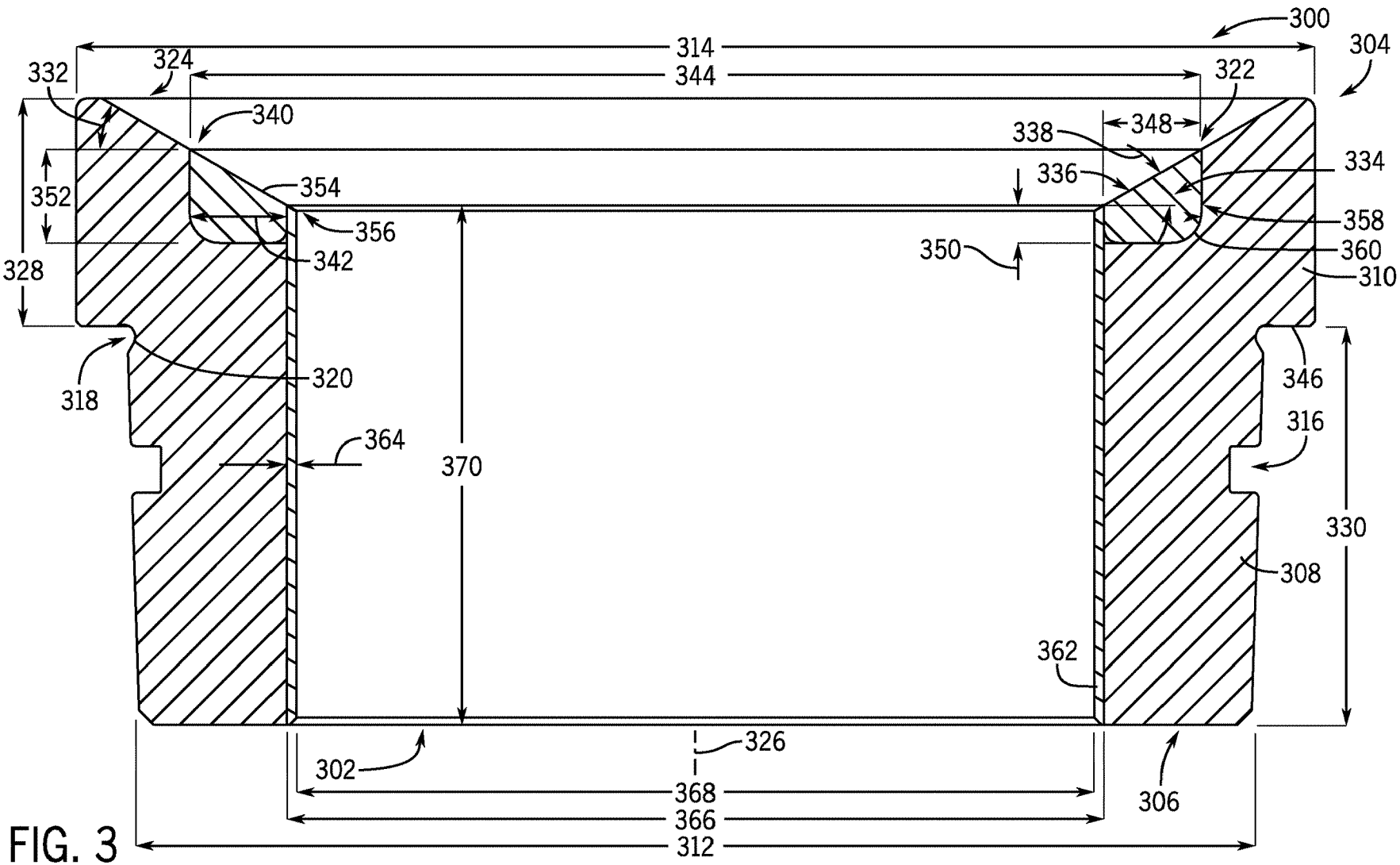
FIG. 3 is a cross-sectional side view of an embodiment of a valve seat, in accordance with embodiments of the present disclosure.

FIG. 3 is a cross-sectional side view of an embodiment of a valve seat 300. The illustrated valve seat 300 may be utilized with a pumping assembly and provide a contact area to engage a valve member in a valve assembly. The illustrated valve seat 300 includes an inner bore 302 that extends from a top region 304 to a bottom region 306. As noted, the recitations of "top" and "bottom" are for illustrative purposes with respect to the disclosed embodiment, but are not intended to limit the disclosure. For example, the "top" may be installed at a vertically lower position than the "bottom."

In various embodiments, the valve seat 300 includes a first body 308 and a second body 310. The first and second bodies 308, 310 may be integrally formed as a unitary component corresponding to the body portion of the valve seat 300. In the illustrated embodiment, the first body 308 includes a first outer diameter 312 and the second body 310 includes a second outer diameter 314. As illustrated, the first outer diameter 312 is less than the second outer diameter 314. It should be appreciated that the first outer diameter 312 is being measured from a radially outward region and not from a seal groove 316 formed in the first body 308. A transition 318 between the first and second body 308, 310 includes a notched region 320. The notched region 320 may be utilized to engage a shoulder formed along a portion of a pressure chamber to secure the valve seat 300 into position. It should be appreciated that the notched region 320 is shown for illustrated purposes only, and that in other embodiments a taper, a bend, or any other transition may be included in place of or in addition to the notched region 320.

The second body 310 includes a strike face 322 extending along a tapered portion 324 of the second body 310. In the illustrated embodiment, the tapered portion 324 has a downward slope from the second outer diameter 314 to a valve seat axis 326. The tapered portion 324 may be described as being constrained to the second body 310, in that the second body 310 may include the region having the second outer diameter 314. In other words, the second body 310 may be defined, in certain embodiments, as the portion of the valve seat 300 extending a first axial distance 328, as opposed to the first body 308 that extends the second axial distance 330 and includes the first outer diameter 312.

The illustrated tapered portion 324 extends circumferentially about the valve seat axis 326 and is arranged at a first angle 332. It should be appreciated that the first angle 332 may be any reasonable angle and may be particularly selected based on operating conditions. For example, the first angle 332 may be approximately 40 degrees. However, the first angle 332 may be approximately 15 degrees, approximately 20 degrees, approximately 25 degrees, approximately 30 degrees, approximately 35 degrees, approximately 45 degrees, approximately 50 degrees, approximately 55 degrees, approximately 60 degrees, approximately 65 degrees, or any other reasonable angle. Moreover, the first angle 332 may be between approximately 15 degrees and 25 degrees, between approximately 25 degrees and 35 degrees, between approximately 35 degrees and 45 degrees, between approximately 45 degrees and 5 degrees, or any other reasonable range.

The strike face 322 forms at least a portion of the tapered portion 324. In various embodiments, the strike face 322 may be considered to cover substantially all of the tapered portion 324. However, in other embodiments, the strike face 322 may be defined as including a portion of the tapered portion 324 that corresponds to a contact region with a valve member 204. This contact region may vary based on the configuration of the valve member. In the illustrated embodiment, an insert 334 is installed along the tapered portion 324 and forms at least a portion of the strike face 322. As noted above, the insert 334 may be a ceramic or high strength material that is positioned to engage the valve member 204 when the valve member 204 is brought into engagement with the valve seat 300.

The illustrated insert 334 includes a sloped region 336 that is substantially equal to the tapered portion 324, thereby forming a smooth sloping surface along the valve seat 300. It should be appreciated that the sloped region 336 may be arranged at a different angle 338 than the angle 332. For example, the sloped region 336 may be positioned at a steeper angle or shallower angle, thereby providing additional options for adjustment due to expected operating conditions. The insert 334 extends circumferentially about the tapered portion 324 and is positioned within a groove 340 that extends radially outward from the bore 302. In other words, an inner portion of the grove 340 may be formed, at least in part, by the bore 302 and an outer portion of the groove 340 may be formed, at least in part, by the second body 310. The groove 340 includes a radial distance 342, which forms a groove diameter 344 that is less than the first outer diameter 312. However, it should be appreciated that, in other embodiments, the groove diameter 344 may be equal to the first outer diameter 312 or greater than the first outer diameter 312. In the illustrated embodiment, the groove 340 does not extend to a shoulder 346 of the second body 310. The shoulder 346 may be utilized to secure the valve seat 300 within the pump assembly. As noted above, while the shoulder 346 is illustrated as a substantially squared-off or straight shoulder, it should be appreciated that other arrangements (e.g., sloped, curved, etc.) may be provided and may be based, at least in part, on the transition 318.

In various embodiments, the insert 334 includes an insert width 348, which may be substantially equal to the radial distance 342, and as a result, the insert 334 may not extend into the bore 302. However, in embodiments, the insert 334 may extend into the bore, for example, when the insert width 348 is greater than the radial distance 342. The illustrated insert 334 further includes a first height 350 and a second height 352, the first height 350 being less than the second height 352, and being connected via a contact surface 354 forming at least a portion of the sloped region 336. In operation, the valve member will contact at least a portion of the contact surface 354. However, because the insert 334 is formed from a hard material, such as ceramic, damage will take longer to accumulate, thereby increasing the life of the valve seat 300.

As shown, both a first end 356, having the first height 350, and a second end 358, having the second height 352, are substantially parallel to the valve seat axis 326. In other words, the illustrated ends 356, 358 are substantially straight with respect to the bore 302. However, it should be appreciated that such an arrangement is for illustrative purposes only. For example, the first or send ends 356, 358 may be sloped. Additionally, the insert 334 is illustrated with a curved end 360 at the second end 358. Again, the curvature is for illustrative purposes and may be an angle or the like, however, it should be appreciated that the curvature may facilitate transmission of forces.

Inclusion of the insert 334 enables improved longevity of the valve seat 300 because the region(s) in contact with the valve member may be formed from stronger and/or harder materials, which may be less susceptible to wear. However, improving the longevity of the strike face 322 may be insufficient if the bore 302 experiences significant damage. In other words, the valve seat 300 may be replaced and/or repaired due to damage at any region, not just the strike face 322. Accordingly, embodiments of the present disclosure include a bore liner 362 extending through at least a portion of the bore 302. The illustrated bore liner 362 protects the bore 302 from damage, for example, from the guide legs 212. For example, the bore liner 362 may be formed from a high strength material, such as a wear resistant metallic alloy, or from a polymer material. The illustrated bore liner 362 has a thickness 364, which may slightly reduce a bore diameter 366. It should be appreciated that the bore diameter 366 and/or the thickness 364 may be particularly selected such that a liner inner diameter 368 is substantially equal to a prior art bore diameter.

The illustrated bore liner 362 extends for an axial length 370 and covers at least a portion of the insert 334. That is, at least a portion of the first insert height 350 is overlapped by at least a portion of the axial length 370. It should be appreciated that, in various embodiments, the entirety of the first insert height 350 may be covered by at least a portion of the axial length 370. However, in other embodiments, less than the entire first insert height 350 may be covered. As a result, the bore liner 362 forms at barrier or separation between the insert 334 and the bore 302. In embodiments, installation of the bore liner 362 prior to the insert 334 may facilitate locating and placement of the insert 334. In order words, the insert 334, in embodiments, does not form a portion of the bore 302.

Figure 4:
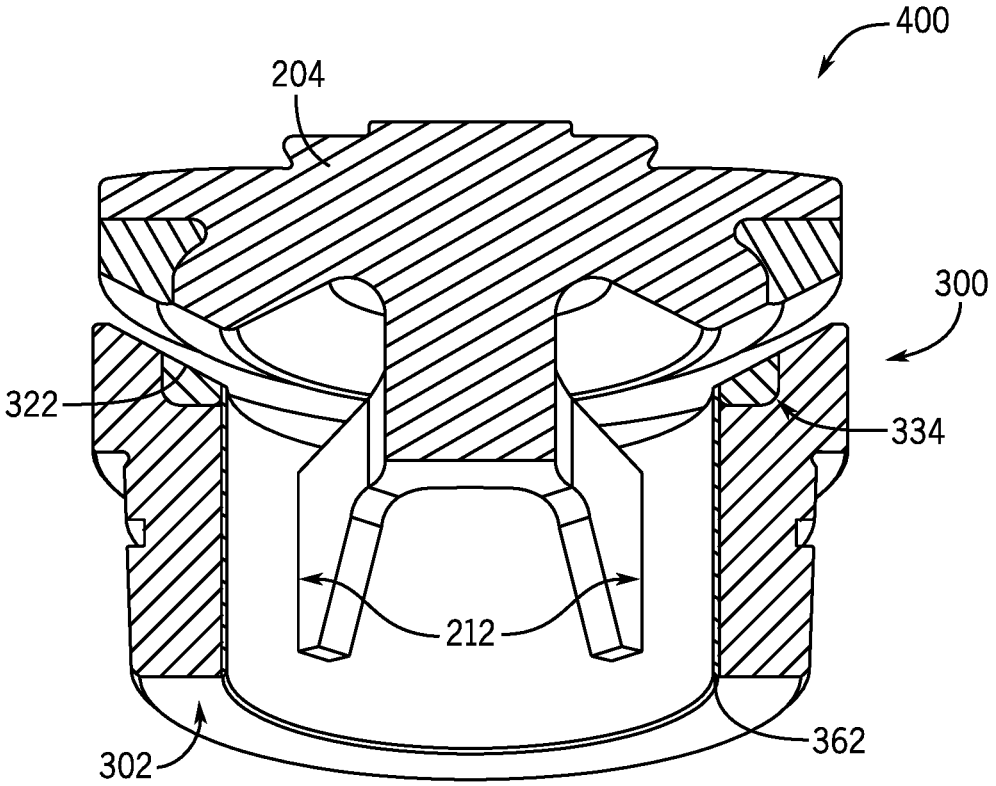
FIG. 4 is a cross-sectional side view of an embodiment of a valve assembly, in accordance with embodiments of the present disclosure.

FIG. 4 is a schematic cross-sectional view of an embodiment of a valve assembly 400 including the valve seat 300 having the insert 334 and the bore liner 362. In the illustrated embodiment, the valve member 204 is positioned within the bore 302 and is arranged to reciprocate between an open position (illustrated) and a closed position (not illustrated). In the closed position, the valve member 204 contacts the strike face 322 of the valve seat 300, for example, at the insert 334. Because the insert 334 is formed from a strong, wear resistant material, repeated contact may have a reduced impact and lead to a longer life for the valve seat 300. Moreover, as noted above, reciprocation may cause contact between the guide legs 212 and the bore liner 362. However, due to the strength of the bore liner 362, wear along the bore 302 is reduced, which also improves the life of the valve seat 300.

Figure 5:
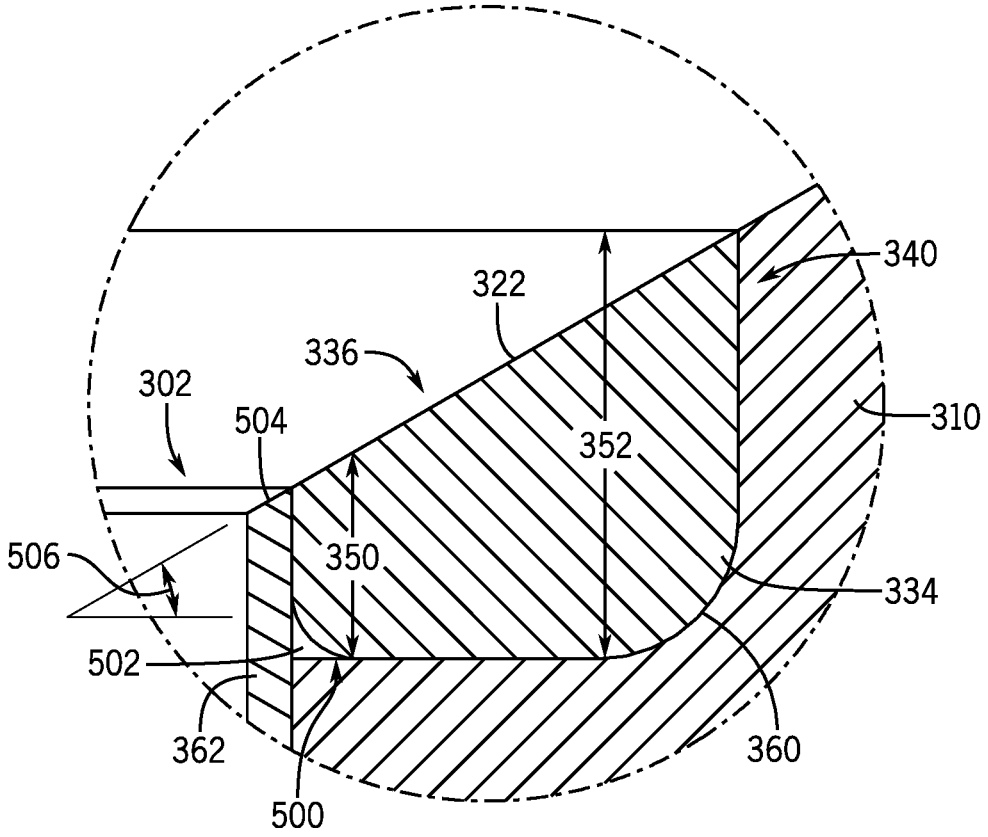
FIG. 5 is a detailed cross-sectional side view of an embodiment of a tapered portion of a valve seat, in accordance with embodiments of the present disclosure.

FIG. 5 is a detailed cross-sectional view of an embodiment of a portion of the second body 310 including the insert 334 arranged within the groove 340. The illustrated groove 340 includes a curved portion that receives the curved end 360 of the insert 334. The insert 334 also includes a second curved end 500 at the first end 346. As a result, there is a gap 502 between the curved end 500 and the bore liner 362. The gap 502 may facilitate expansion of the materials, for example, due to pressure and temperature.

As previously noted, at least a portion of the bore liner 362 may overlap at least a portion of the insert 334. In the illustrated embodiment, the entire first insert height 350 is covered by the bore liner 362. It should be appreciated, as noted above, that the bore liner 362 may not overlap the entire insert 334. However, in various embodiments, at least a portion of the bore liner 362 overlaps at least a portion of the insert 334 to form a barrier between the insert 334 and the bore 302.

The bore liner 362 includes a sloped top 504, arranged at an angle 506, that substantially conforms to the insert angle 338. It should be appreciated that the sloped top 504 may be omitted in other embodiments. That is, the top may be substantially planar. The illustrated portion of the tapered portion 324 is substantially constant. In other words, the angles 332, 338, 506 are substantially equal, thereby forming a smooth transition along the tapered portion 324.

Figure 6:
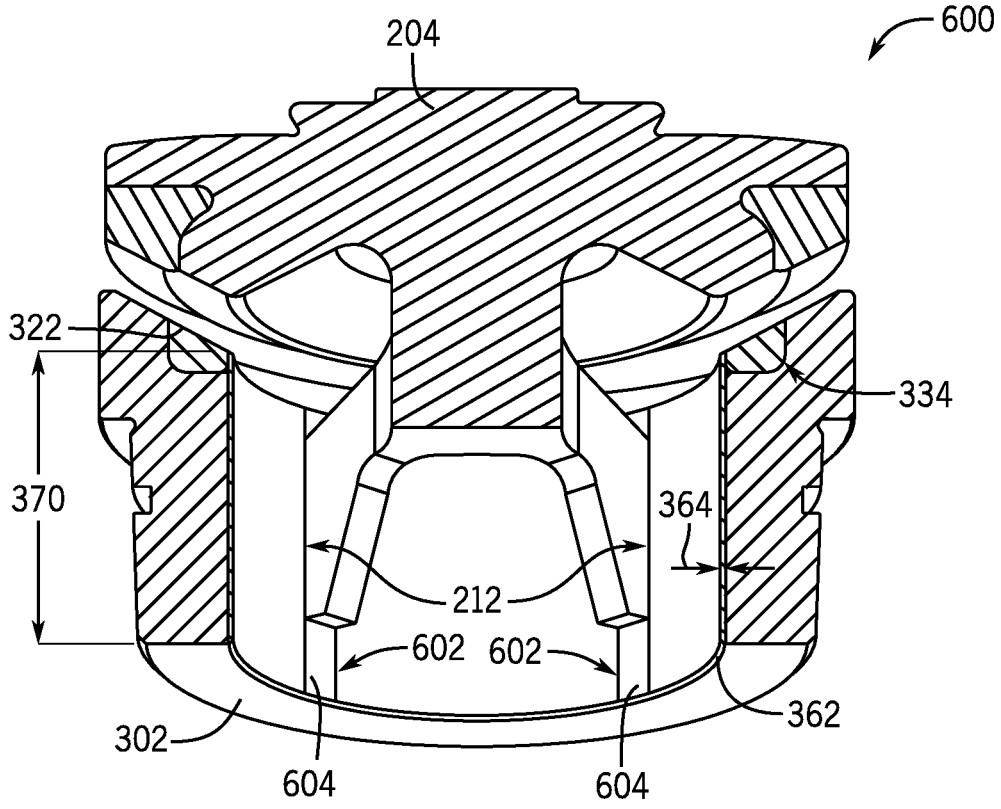
FIG. 6 is a cross-sectional side view of an embodiment of a valve assembly, in accordance with embodiments of the present disclosure.

FIG. 6 is a schematic cross-sectional view of an embodiment of a valve assembly 600 including the valve seat 300 having the insert 334 and the bore liner 362. The illustrated embodiment differs from the embodiment shown in FIG. 4 in that the bore liner 362 includes guides 602 for the guide legs 212. For example, the guides 602 include a recessed portion 604 extending into the liner thickness 364 to receive the legs 212. As a result, rotation of the valve member may be reduced or eliminated due to the fixed location within the guides 602. In various embodiments, the material within the guides 602 may also be different from the material of the remainder of the bore liner 362, due to the concentration of the guide leg movement. For example, the material within the guides 602 may be formed from a high strength or resilient material, which may have increased costs, compared to other portions of the bore line 362. The illustrated guides 602 may extend for the entire axial length 370 of the bore liner 362 or along only a portion of the bore liner 362. As a result, the bore 302 may be protected from wear due to the reciprocating movement of the valve member 204.

Figure 7:
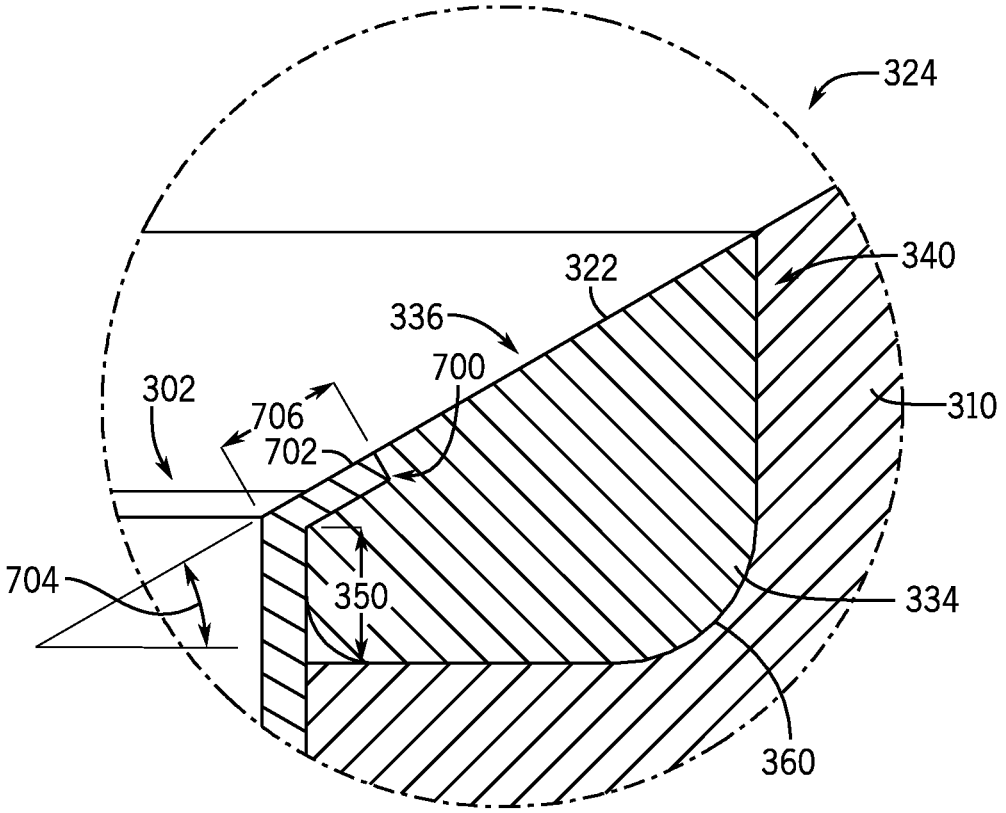
FIG. 7 is a cross-sectional side view of an embodiment of a valve seat, in accordance with embodiments of the present disclosure.

FIG. 7 is a detailed cross-sectional view of an embodiment of a portion of the second body 310 including the insert 334 arranged within the groove 340. In the illustrated embodiment, the bore liner 362 extends to cover the first insert height 350. Moreover, the insert 334 includes a slot 700 for receiving an extension 702 of the bore liner 362. As shown, the extension 702 is positioned within the slot 700 and is arranged at an angle 704, which substantially conforms to the insert angle 338, thereby forming the smooth sloped profile of the tapered portion 324. It should be appreciated that, in various embodiments, an extension length 706 may be particularly selected. For example, the extension 702 may be designed to extend onto the strike face 322 such that the extension 702 is contacted by the valve member 204. However, in other embodiments, the extension 702 may be positioned such that it does not extend to the strike face 322. Moreover, the extension 702 may not be a continuous, circumferential piece, but rather, there may be gaps between a plurality of extensions 702, such that the extensions 702 extend outward like petals or fingers. In various embodiments, the extension 702 may facilitate securing the bore liner 362 to the bore 302 and/or the insert 334. As will be described, the bore liner 362 can be press fit, bonded, or metallurgically fused to the valve seat.

As noted above, embodiments of the present disclosure are directed toward incorporating harder and/or stronger materials into valve seats in order to improve effective life. For example, traditional valve seats may be formed by an alloy steel. Repeated contact with a valve member, which may lead to wear and erosion, especially when utilized with environments with corrosive fluids and/or particulates in the fluid. Embodiments of the present disclosure incorporate high strength materials, such as ceramic materials, resistant steels, or polymers, into the valve seats at areas where contact is made with the valve member. These materials may be incorporated in a variety of ways, such as bonding, press fitting, sintering, or a combination thereof. As a result, a majority of the valve seat may be formed from cheaper materials, such as alloy steels, with more expensive materials being focused at the areas of contact.

Figure 8:
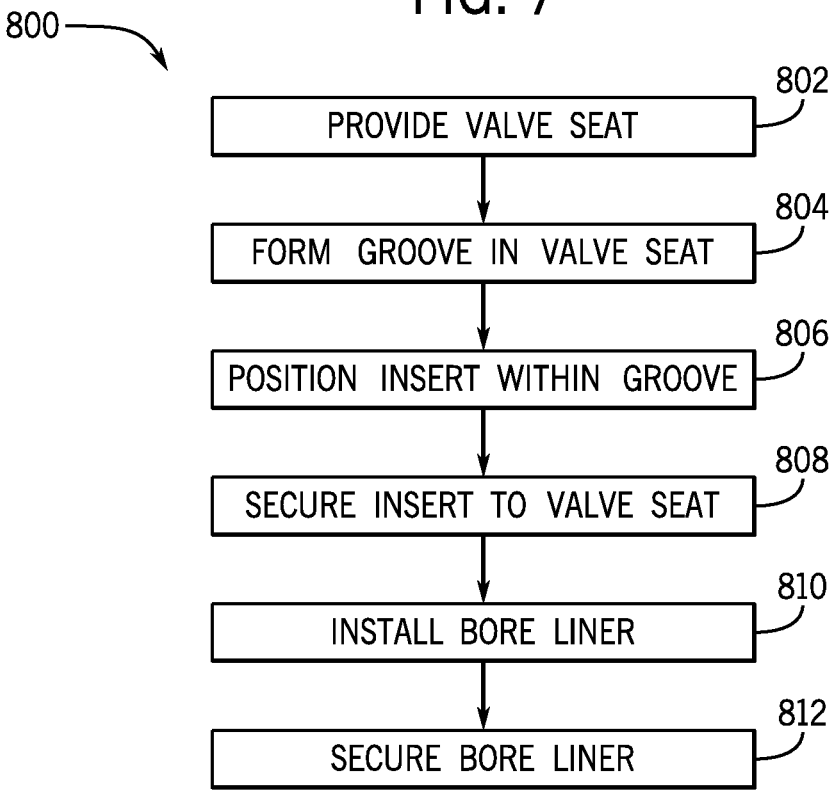
FIG. 8 is a flow chart of an embodiment of a method for forming a valve seat, in accordance with embodiments of the present disclosure.

FIG. 8 is a flow chart of an embodiment of a method 800 for forming a valve seat. It should be appreciated that the method may include additional or fewer steps. Additionally, the steps may be performed in a different order or in parallel. This example begins with providing a valve seat 802. For example, the valve seat may be a forged or machined part that is manufactured to one or more specifications, such as specifications for a particular pump. A groove is then formed in the vale seat 804. The groove may be formed to receive the insert, as described above. It should be appreciated that the valve seat may be provided with the groove. For example, in embodiments where the valve seat is cast, the groove may be part of the casting. The insert is then arranged within the groove 806 and secured to the valve seat 808. For example, the groove may be particularly formed to receive the insert (e.g., matching dimensions). Securing the insert may include a variety of different manufacturing processes such as press fitting, bonding, or metallurgically fusing the insert to the valve seat. As a result, the valve seat may include an improved strike face.

Embodiments of the present disclosure may also be directed toward providing strengthening and protection to the valve bore. For example, a bore liner may be installed within the bore of the valve seat 810. In embodiments, the bore liner is substantially cylindrical, like the bore. Moreover, the bore liner may be sized to engage the bore. For example, the bore liner may have an outer diameter that is substantially equal to the inner diameter of the bore. Thereafter, the bore liner may be secured to the valve bore 812. As noted above, the bore liner may be press fit, bonded, or metallurgically fused to the bore. Additionally, in embodiments, the bore liner may be mechanically coupled to the insert. Accordingly, embodiments of the present disclosure provide a valve seat having protective surfaces arranged along the bore and the strike face.

The foregoing disclosure and description of the disclosed embodiments is illustrative and explanatory of the embodiments of the disclosure. Various changes in the details of the illustrated embodiments can be made within the scope of the appended claims without departing from the true spirit of the disclosure. The embodiments of the present disclosure should only be limited by the following claims and their legal equivalents.

The invention claimed is:

1. A valve assembly for a fracturing pump, comprising:

a valve seat having a bore extending therethrough, the valve seat including a strike face at a top region opposite a bottom region, at least a portion of the strike face formed by an insert positioned within a groove formed in the valve body;

a bore liner arranged within the bore, at least a portion of an axial length of the bore liner covering at least a portion of the insert to form a barrier between the insert and the bore;

a valve member positioned to reciprocate within the bore, the valve member moving between an open position and a closed position, wherein at least a portion of the valve member engages at least a portion of the strike face in the closed position; and a guide of the bore liner extending longitudinally along at least a second portion of the axial length, the guide including a recessed portion that receives at least a portion of a guide leg of the valve member.

2. The valve assembly of claim 1, wherein the insert is formed from a ceramic material, a wear resistant steel, a polymer, or a combination thereof.

3. The valve assembly of claim 2, wherein the insert is formed from a different material than the valve seat.

4. The valve assembly of claim 1, the valve seat further comprising:

a first body having a first diameter, at least a portion of the bore extending through the first body; and a second body having a second diameter, the second diameter being larger than the first diameter, and a tapered portion, the tapered portion forming at least a portion of the strike face.

5. The valve assembly of claim 4, further comprising:

a transition between the first body and the second body, the transition being a substantially right angle to form a shoulder at the second body.

6. The valve assembly of claim 1, further comprising:

a sloped region of the insert, the sloped region substantially conforming to a tapered portion of valve seat; and a sloped top of the bore liner, an angle of the sloped top being substantially equal to the sloped region of the insert.

7. The valve assembly of claim 1, wherein the insert includes a first end having a first height proximate the bore and a second end having a second height, greater than the first height, distant from the bore, wherein the portion of the axial length of the bore liner is substantially equal to the first height and less than the second height.

8. A valve seat for use in a fracturing pump, comprising:

a first body, including at least a portion of a bore and having a first diameter;

a second body, coupled to the first body, the second body comprising:

a tapered portion having a downward slope from a second diameter to an axis;

a groove formed in the tapered portion, the groove extending from at least a second portion of the bore radially outward toward the second diameter; and an insert, positioned within the groove, the insert having a sloped region substantially conforming to the downward slope of the tapered portion; and a bore liner extending through the bore along at least a portion of both the first body and the second body, the bore liner positioned to overlap at least a portion of the insert, and the bore liner including a guide extending longitudinally along at least a portion of an axial length of the bore liner, the guide including a recessed portion that receives at least a portion of a guide leg of a valve member positioned to reciprocate within the bore.

9. The valve seat of claim 8, wherein the insert is formed from a ceramic material, a wear resistant steel, a polymer, or a combination thereof.

10. The valve seat of claim 8, further comprising:

a transition between the first body and the second body, the transition forming a shoulder for supporting the valve seat within the fracturing pump.

11. The valve seat of claim 8, wherein the insert includes a curved portion substantially conforming to a curved region of the groove.

12. The valve seat of claim 8, wherein the bore liner further comprises:

an extension arranged at an angle, the extension being positioned within a slot formed in the insert.

13. The valve seat of claim 8, wherein the insert is positioned to form at least a portion of a strike face of the valve seat, the strike face receiving contact from a valve member reciprocating within the bore.

14. The valve seat of claim 8, wherein the insert is coupled to the second body via a bonding process, a press fitting process, a sintering process, or a combination thereof.

15. A method for forming a valve seat, comprising:

providing a valve seat, the valve seat including a first body and a second body coupled together, the first body having a larger diameter than the second body, the second body including a tapered portion;

forming a groove in the tapered portion, the groove extending radially outward from the bore;

positioning an insert within the groove;

securing the insert within the groove;

positioning a bore liner along at least a portion of the bore, the bore liner arranged to overlap at least a portion of the insert, the bore liner including a guide extending longitudinally along at least a portion of an axial length of the bore liner, the guide including a recessed portion that receives at least a portion of a guide leg of a valve member positioned to reciprocate within the bore; and securing the bore liner to at least one of the bore or the insert.

16. The method of claim 15, wherein securing the insert within the groove comprises:

coupling the insert to the second body via a bonding process, a press fitting process, a sintering process, or a combination thereof.

17. The method of claim 15, wherein the insert is formed from a different material than the second body.

18. The method of claim 15, wherein the bore liner is installed after the insert is positioned within the groove.

* * * * *